US005722789A

United States Patent [19]

Murray et al.

[11] Patent Number: 5,722,789

[45] Date of Patent: *Mar. 3, 1998

[54] MULTI-WIDTH CUTTER

[75] Inventors: Stuart W. Murray, Brentwood, Tenn.; Gunter R. Hähn, Koenigswinter, Germany

[73] Assignee: Wirtgen America, Inc., Nashville, Tenn.

[ * ] Notice: The term of this patent shall not extend beyond the expiration date of Pat. No. 5,505,598.

[21] Appl. No.: 627,443

[22] Filed: Apr. 4, 1996

Related U.S. Application Data

[63] Continuation-in-part of Ser. No. 282,329, Jul. 29, 1994, Pat. No. 5,505,598.

[51] Int. Cl.[6] ..... E01C 23/12

[52] U.S. Cl. ..... 404/90; 299/39.4

[58] Field of Search ..... 404/90, 91; 299/39.4, 299/80.1

[56] References Cited

U.S. PATENT DOCUMENTS

| | | | |
|---|---|---|---|
| 4,489,985 | 12/1984 | Kendrick | 299/80 |
| 4,720,207 | 1/1988 | Salani | 404/90 |
| 5,083,839 | 1/1992 | Younger | 299/89 |
| 5,505,598 | 4/1996 | Murray | 404/90 |

OTHER PUBLICATIONS

CMI Corporation, Varialbe–Width Cutters for Roto–Mill PR 800–7, PR650 #PR 500B Pavement Profilers (Feb. 1943).

*Primary Examiner*—William P. Neuder

*Attorney, Agent, or Firm*—Waddey & Patterson; I.C. Waddey, Jr.

[57] ABSTRACT

A modification of a cold milling machine used to remove concrete and asphalt from an existing highway is disclosed, including a milling drum segmented into two or more sections with the drive train for the milling drums passing through the core of the milling drum and supported via a journal or bearing to the outside of the machine. The width of the milling drum can be varied by replacing one section of drum with a segmented drum that is either wider or narrower. The sections of the milling drum can be added by bolting segments of the drum onto a driven sleeve which telescopes over the drive shaft of the machine. The segments of the milling drum can be readily removed by loosening a few bolts and removing the segments without having to slide a milling drum segment off of either end of a drive shaft.

7 Claims, 7 Drawing Sheets

MULTI-WIDTH CUTTER

RELATED PATENT APPLICATIONS

This application is a continuation-in-part of application Ser. No. 08/282,329 filed on Jul. 29, 1994, now U.S. Pat. No. 5,505,598, by Stuart W. Murray, one of the co-inventors of the invention of this application.

BACKGROUND OF THE INVENTION

The present invention relates generally to milling machines and more particularly to milling machines for asphalt, concrete, and other road surface materials so that a worn surface may be removed and replaced with new material. Milling machines of this type have, in the past, had fixed width cutters. Multi-width cutters are known in the prior art, but they have been difficult to assemble or modify and have had other disadvantages.

The invention disclosed in the application from which this application is a continuation-in-part made adjustment of the size of the cutter easier, reducing down time and associated labor cost and expense. The parent application provided an improvement of known machines by providing a cutter that could be readily and easily converted from one width to another and particularly, to provide for a cutting width of 2', 3' or 4' (or any other selected increments between 24" and 52") with minimal down time in the operation of the machine and with minimal man power required to make the conversion. Further, the invention of the parent application was designed to enable each cut to be made at the optimal outside location of the machine so that the machine could make different width cuts directly adjacent bridge abutments, embankments, and severe slopes (such cuts being generally referred to in the industry as "flush cuts" and the practice of milling directly adjacent a barrier as "flush cutting").

While the parent application disclosed a major improvement over the machines of the prior art, the machine as disclosed in the parent application, in practice, has experienced uneven wear of the teeth on the milling drum. Specifically, the parent machine employed a 2' drum that was mounted on the flush side of the machine and which was attached permanently to the drive train output. Variations in the width of the cutter were accomplished by adding segmented sections of a drum to the permanent section of the drum. Thus, the drum could be increased by 1' increments (or any other convenient increment as one might choose) from 2' up to 4' or more and back down to a smaller width. However, because the 2' segment of the drum was always attached to the machine and was always in use during any operation of the machine regardless of the width of the drum, the tooth holder of the 2' segment of the drum experienced greater wear as compared to the tooth holder on the other segments of the drum. The improvement which constitutes the subject matter of the present application is a modified drum assembly which can be easily and quickly converted from one width to another and which recognizes and overcomes the foregoing problem.

It will be appreciated by those skilled in the art that highways, parkways, roads and streets that serve as thoroughfares for motor vehicle travel in this country are subject to tremendous wear and tear and eventual decay. Also, there are often occasions when roads and highways must be improved by widening them or adding lanes in order to accommodate increased motor vehicular traffic. Such roads and highways are generally paved with concrete or asphalt. In order to repair them, it is usually necessary to remove the concrete or asphalt, or to remove at least a portion of the concrete and asphalt, requiring a cut of several inches of depth.

When existing roads are be repaired, it is necessary to remove the material of the portion of the road or highway passing beneath overpasses so that when new material is paved over the existing surface, the height of the road will not be increased and thereby reduce the clearance between the road and the overpass. Such clearances are generally specified to reasonably close tolerances and if the repair of the road increases the height of the road by adding new material to it, after several repairs, the clearance between the road and the overpass will be reduced to a point that certain traffic, particularly tractor trailer rigs and the like would crash into the lower side of the overpass if the material of the road was not removed prior to repaving. Likewise, on bridges and overpasses, when roads are repaired, it is necessary to remove the existing material before applying a new surface in order to reduce the weight on the bridge or overpass, such bridges and overpasses normally having been engineered to accommodate a specified weight limit. Continually adding new weight by adding the weight of resurfacing material may exceed the limitations of such bridges and overpasses when the weight of vehicles traveling over those bridges and overpasses is added to the equation.

Finally, in the repair of the existing roads and highways, there are numerous bridge abutment, guard rail and other traffic control barriers along the roads. It is important to be able to remove the asphalt or concrete as closely adjacent such barriers as possible through automatic equipment and milling machines of the type to which this invention is directed so as to eliminate manual labor in removing the material directly adjacent such barriers. Similarly, it is important to be able to use milling machines to remove material adjacent embankments and slopes without having to use manual labor for that job.

In the improvement of existing highways and roads, particularly when highways and roads are being widened, cuts have to be made in the existing shoulder of the old road in order to provide for a base of rock and other compressed material and a layer of asphalt or concrete over the base material. The finished job must have the widened portion of the highway be at the same level as the refinished existing highway. These cuts often have to be made in cities adjacent sidewalks, over existing roads adjacent bridges and other areas where embankments, slopes, and highway appurtenances require that the machine cut at its extreme most outside edge because there is no room for the tracks of the machine beyond the cutting point.

It is appropriate to note at this point of discussion of the background of the invention that in machines of this type, the power train for driving the cutter is generally positioned on what is referred to as the "inside" of the machine because if it were located on the "outside" of the machine, it would extend beyond the cutting edge and limit the ability of the machine to make flush cuts. Further, practical aspect of the design of machines of this nature require that the drive train provide power to the cutter via an axle passing through the cutter itself and drive the cutter from the inside of the machine.

In machines currently available in the marketplace, such as machines available through Applicant's assignee, Wirtgen America, Inc., Nashville, Tenn., for the milling machine to make cuts of varying width, the entire cutter has to be removed and replaced with a different sized cutter. Such devices include the Wirtgen 1300–2000 DC cold milling machine which is readily available on the marketplace and which is illustrated and described in the sales brochure attached hereto and incorporated herein by reference.

Cold milling machines are the type that our invention is designed to modify fall in the category of road building or material handling equipment. The machines themselves may cost as much as $750,000 or more and the cost of a milling drum with cutter elements can be as much as $200,000. Thus, while there have been provided machines that allow different cutting widths by interchanging the milling drums, such devices require that the operator have on hand two or more milling drums and if the operator is required to purchase several milling drums, the cost of each additional drum is significant. Further, in existing equipment, conversion from one width to another by exchanging one milling drum for another requires several men because of the size and weight of the equipment and may take as much as two full days to accomplish. One days down time for a machine of this type is a significant economic loss to the contractor because it slows the completion of the job and requires the use of expensive man power.

What is needed then is a product for and method of conveniently and quickly changing the width of cut of a milling drum in a cold milling machine designed for making cuts of a depth up to 12" in highway concrete, asphalt and rock base and in widths varying from 2' to 4' or more. Further, what is needed is such a machine that will insure even wear on the tooth holders of the various segments of the drum so that, over time, the depth of cut will always be the same regardless of the width of the cut. Such a device is presently lacking in the prior art and in the marketplace.

It is therefore an object of the present invention to provide a new and improved cold milling machine that can be readily converted from one cutting width to another with use of minimum man power and time.

It is another object of the present invention to provide such an improved cold milling machine that will allow cuts of up to 12" deep substantially in line with the outside of the machine.

It is a further object of the present invention to provide an improved machine with a moldboard or scraper that can be varied in width to accommodate varying widths of the cutter and can be varied in height along its width to accommodate the depth of cut being performed by the machine.

It is yet another object of the present invention to provide such an improved cutter where the change in the width of the cutter can be accomplished by a single workman using simple hand tools and accomplished within 2–3 hours.

It is still another object of the present invention to provide an improved cutter that will insure even wear on the tooth holder of the various segments of the drum so that the depth of cut will be uniform regardless of the depth of cut or the segments of the drum in use.

Having described generally the objects of the present invention, Applicants' invention will be better understood when considered in light of the accompanying drawings and the following description of the preferred embodiment.

SUMMARY OF THE INVENTION

A modification of a cold milling machine used to remove concrete and asphalt from an existing highway is disclosed, including a milling drum segmented into two or more sections with the drive train for the milling drums passing through the core of the milling drum and supported via a journal or bearing to the outside of the machine. The width of the milling drum can be varied by replacing one section of drum with a segmented drum that is either wider or narrower. The sections of the milling drum can be added by bolting segments of the drum onto a driven sleeve which telescopes over the drive shaft of the machine. The segments of the milling drum can be readily removed by loosening a few bolts and removing the segments without having to slide a milling drum segment off of either end of a drive shaft.

DESCRIPTION OF THE PREFERRED EMBODIMENT

The invention will be best understood when considered in conjunction with the attached drawings which illustrate the preferred embodiment of the invention. In the description of the preferred embodiment, the cold milling machine will be described in conjunction with the drawings as they are oriented.

Before describing Applicant's invention itself, a brief description of a cold milling machine of the type for which Applicant's invention is designed will be necessary. The following description of the machine itself is for background purposes only. Such devices are available in the marketplace and have been sold, distributed and in public use for many years.

Figure 1:
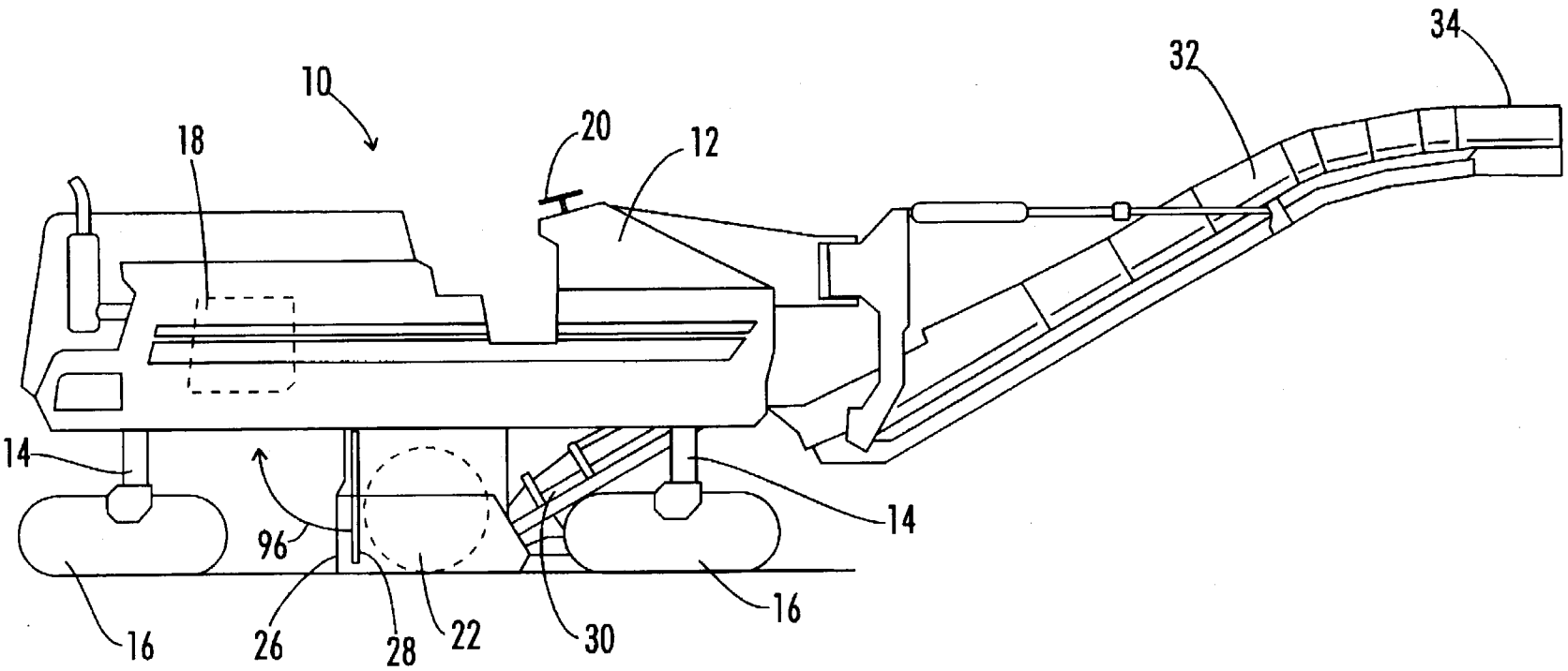
FIG. 1 is a schematic illustration of a side view of a machine of the type which Applicant's invention is designed to modify.

The cold milling machine for which the present invention is adapted is illustrated generally at 10 in FIG. 1. The machine 10 has a body 12, hydraulically adjusted shuts 14 on which are mounted wheels or tracks 16. The present invention will be described in conjunction with a machine 10 which is propelled by the movement of the tracks 16 although some variations of the device employ rubber tired wheels when the application so demands. The tracks 16 are hydraulically driven through any well known gearing system through a power train powered by a diesel engine 18. Steering linkage (not shown) connects the steering wheel 20 to the tracks 16 to guide the machine 10.

Figure 6:
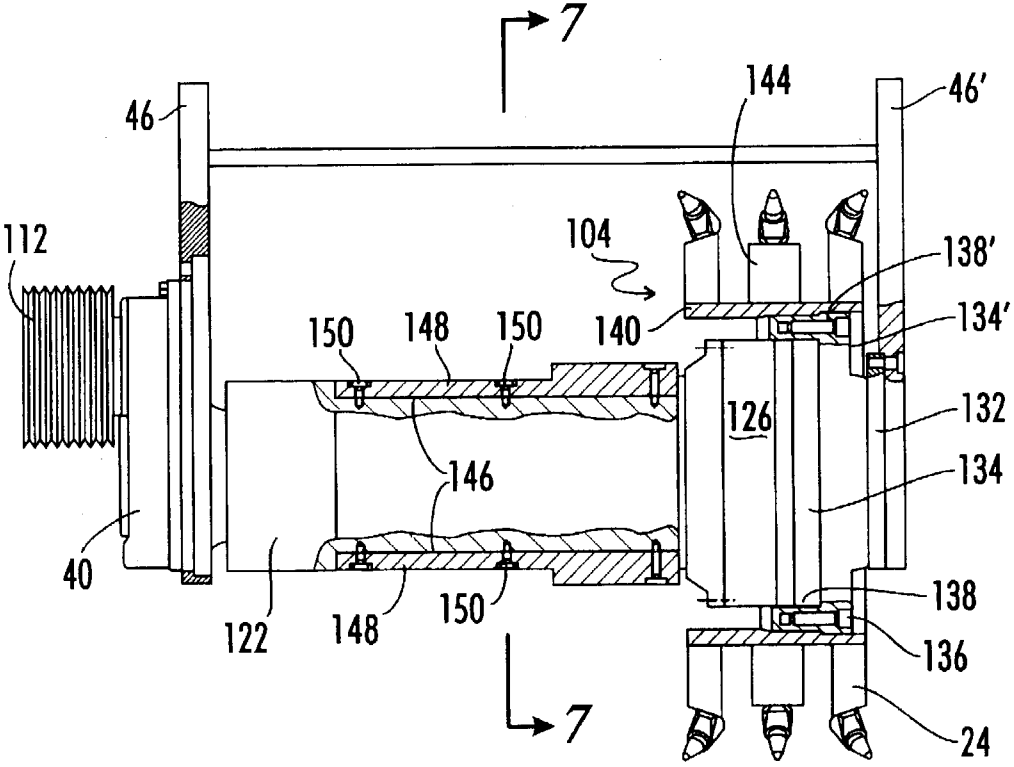
FIG. 6 is a view of the milling drum from the rear of the machine in partial cross section and providing a 1' cut by the drum.

Mounted beneath the body 12 is a milling drum 22. The milling drum 22 is provided with teeth 24 positioned to form a helical cutter wound about the milling drum 22 (See FIG. 6). The milling drum 22 is contained within the drum housing generally referred to by reference numeral 26. Considered in the orientation of the view shown in FIG. 1, the milling drum 22 rotates in a counter clockwise direction causing the teeth 24 to generate a succession of cuts in the pavement beneath the milling drum, each cut being slightly to the left of the preceding cut and eating into the face of an embankment into which the machine 10 is driven. The milling drum 22 can be driven in a clockwise direction to perform what is known as a "downcut" with the operation otherwise being as just described.

A structure commonly referred to as a moldboard is mounted on the underside of the body 12 of the machine 10 directly behind the milling drum. The moldboard is shown generally at 28 in FIG. 1. Moldboard 28 is positioned to track along, and in engagement or near engagement with, the cut surface immediately behind the milling drum 22. The moldboard 28 assists in containing cut material within a confined space so that the cut material will be swept toward the front of the device 10 and, because of the helical arrangement of the teeth 24, toward the left or inside of the machine. In a full width milling drum 22, the helically wound teeth are arranged such that the helical effect tends to move the waste material toward the center of the machine. Thus, waste material is moved from the outside of the machine toward the left and from the left (or inside of the machine) to the right or inside portion of the machine.

As the waste material is accumulated toward the center of the milling drum 22, the waste material is dumped into trough 30. Trough 30 may be equipped with any convenient conveyer type mechanism, generally a looped rotating conveyer belt with paddle wheels on it, to convey the material from its lower rear portion to its upper front portion and dump the material into the discharge conveyer 32. The discharge conveyer 32 is, once again, equipped with any convenient conveyer mechanism, generally a looped rotating conveyer belt with paddle wheels appended thereto, for advancing the waste material from its lower rear portion to its upper forward most portion. The conveyer 32 has an open end at its upper forward most portion 34 which dumps the waste material into a truck or other vehicle being driven in front of the machine 10. Once the track is filled, the waste material may be carded from the cite and disposed of in a properly manner, and a second track is placed below the conveyer 32 to allow the operation to continue.

Figure 2:
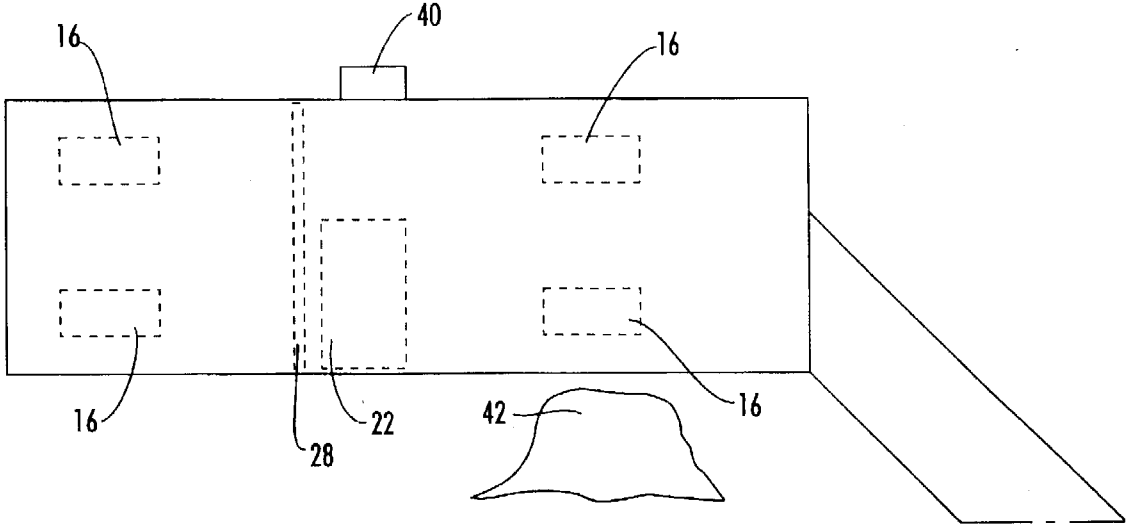
FIG. 2 is a plane view in schematic form of the device of the present invention showing a 3' cutter width.
Figure 3:
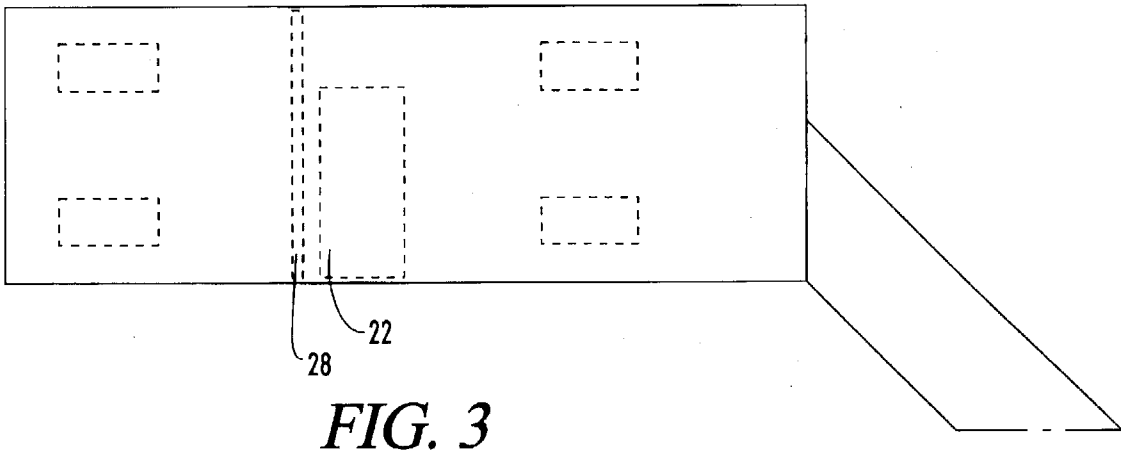
FIG. 3 is a plane view in schematic form of the improvement of the present invention showing the cutter in a 4' configuration.
Figure 5:
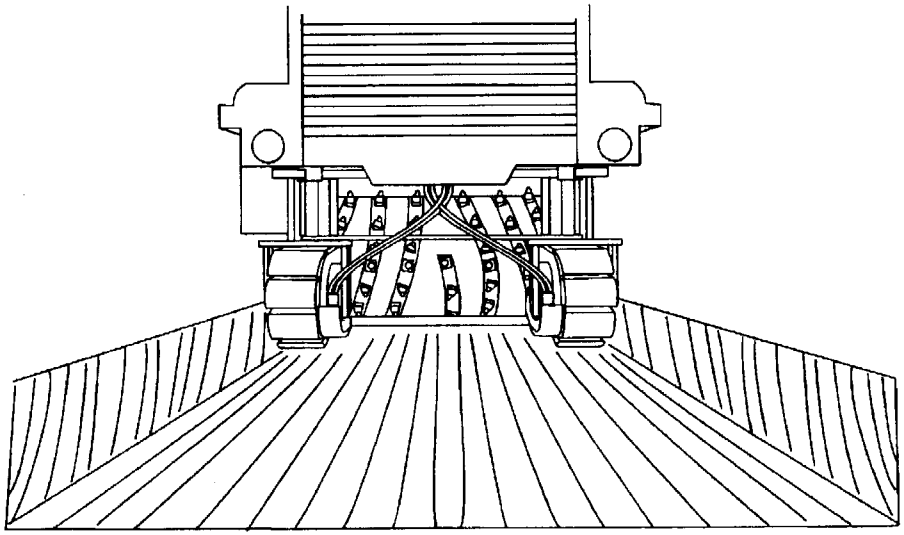
FIG. 5 shows a rear view of the present invention in a 6' configuration.
Figure 4:
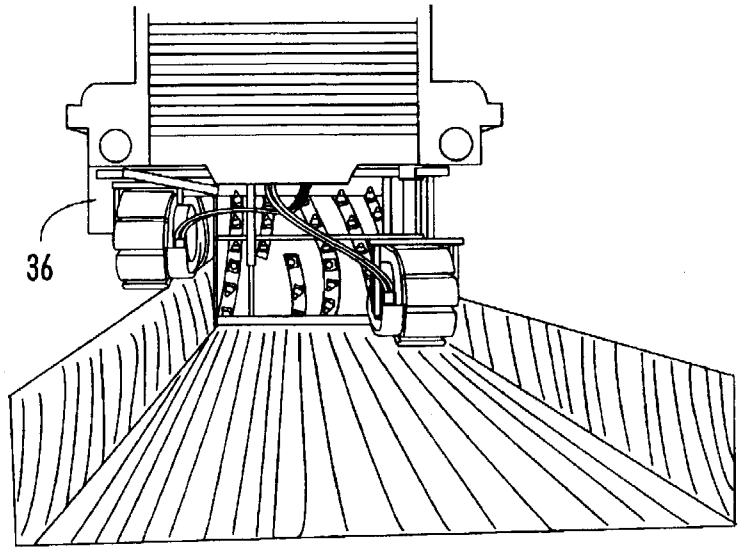
FIG. 4 shows a rear view of the improvement of the present invention with the cutter in 4' configuration.
Figure 7:
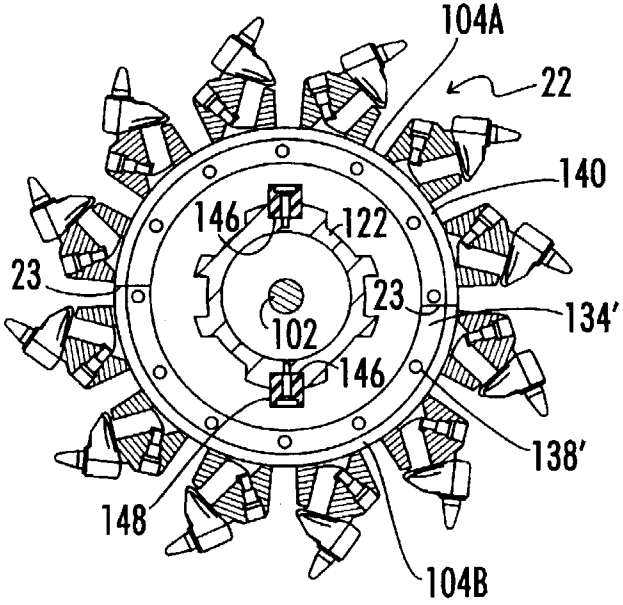
FIG. 7 is a cross section taken along the line A—A in FIG. 6.

FIG. 2 shows a schematic of a machine 10 equipped with a 3' milling drum 22 and FIG. 3 shows schematic of a machine 10 equipped with a 4' milling drum 22. Similarly, FIG. 4 shows a rear view of a machine equipped with a 4' milling drum and FIG. 5 shows a rear view of a machine equipped with a 6' milling drum 22. In FIGS. 4 and 5, the helical pattern of the teeth on the milling drum 22 can be readily seen.

The power to drive the milling drum 22 is transmitted from the diesel engine 18 through a clutch and power band to a reduction gear for maximum milling efficiency. Units of the type shown schematically in FIG. 1 will generally be provided with independent hydraulic systems for driving the conveyers, cooler fans, water sprinkler units and control functions. The hydrostatic pumps for the hydraulic systems are driven by the diesel engine via a splitter gear box. As the machine 10 moves in a forwardly direction (to the right in FIG. 1), the milling drum 22 is rotating in a counter clockwise direction, causing the teeth 24 to make the desired cut.

The power output of the diesel engine 18 is at a relatively high rpm. In order to convert the high rpm output to the power necessary to drive the milling drum 22 through dense rock, concrete, asphalt or other road surfaces, a gear reduction system is necessary. The power output of the diesel engine 18 includes a belt driven power train shown generally at 36 in FIG. 4. The power train 36 is housed within a housing and because of design limitations, generally the housing and drive train 36 protrude from the left side of the machine 10 (as viewed in FIG. 4). If the drive train and its housing were on the fight side of the machine 10, it would protrude beyond the outside cutting edge of the milling drum 22 and would prevent the machine from making flush cuts directly adjacent road barriers, bridge abutments and the like that would be to the right of the machine. As can be seen from FIG. 2, such a barrier 42 will limit only modestly the extent of the reach of the milling drum 22. However, if the housing 40 were on the outside of the machine, the reach of the milling drum 22 would have to be substantially removed from the barrier 42.

Because of the size, power and design restrictions of machines such as this, based on the magnitude of the work performed and resistance to cuts of the milling drum 22 by virtue of the type of work being performed, the equipment is generally big, powerful, bulky and must be built within certain design limitations. It is not convenient to feed the power to the milling drum 22 from any place other than outside the body of the machine 10 without making the machine even larger. The power train cannot be connected to the milling machine inside the length of the milling machine without being overwhelmed by the debris and waste material created by the cutter. Further, in order to adequately transfer power to the milling drum 22, it is generally necessary to use a planetary gearing system which drives the milling drum from the inside. The features and limitations of such a system are described in more detail in connection with the description of the invention of the parent application, reference to which can be had for a more complete understanding of the operation of such devices. However, it is noteworthy to point out at this stage of the description of the machine to which Applicants' invention is directed that restrictions on design of the power train of such machines creates substantial barriers to the production of a machine that will achieve the desired results.

Heretofore, a number of problems that Applicants' invention addresses had to be solved by simply replacing one milling drum for another. For example, if a 6' cut were being made along a highway using a drum of the type as shown in FIG. 3, and the machine reached a point where the maximum cut permissible was 4', the 6' drum 22 of FIG. 3 would have to be replaced with a 4' drum 22 as shown in FIG. 2. The cost of having two drums on hand would be substantial and the man power and down time necessary to change the drums was significant and costly.

Applicant's invention has addressed and solved these problems by providing a milling drum, the cutting width of which can be readily and easily changed by one man using simple available hand tools in the course of a few hours. Applicants' invention will be described in conjunction with a combination cutter that can be modified from a 2' cut to a 3' cut to a 4' cut. While these combinations have been selected as optimal for the specific design of Applicants' invention, other designs would certainly be within the concept of the present invention. It would simply be a matter of changing the size of the three or more stages of the cutter. The cutter could also be limited to only two stages if desired. However, for the purposes of describing the preferred embodiment of this invention, reference will be had to the optimal combination which includes a 2' segmented cutter, a 3' segmented cutter to replace the 2' cutter to make the cutting width 3', and a third segmented cutter, 4' in length, that can be used to replace either the first or second cutters to provide a cutter of 4' length. As is illustrated and described in the parent application, the moldboards of this machine can be adjusted with a first segment of the moldboard to the extreme right of the machine being 2' in width, a second segment of the moldboard immediately to the left of the first segment of the moldboard 1' in width and a third segment of the moldboard immediately to the left of the second segment of the moldboard and being 1' in width. By structuring the moldboard in such a manner, the moldboard can be adjusted to mirror the width of the cutting drum, all as is described in the parent application.

Figure 11:
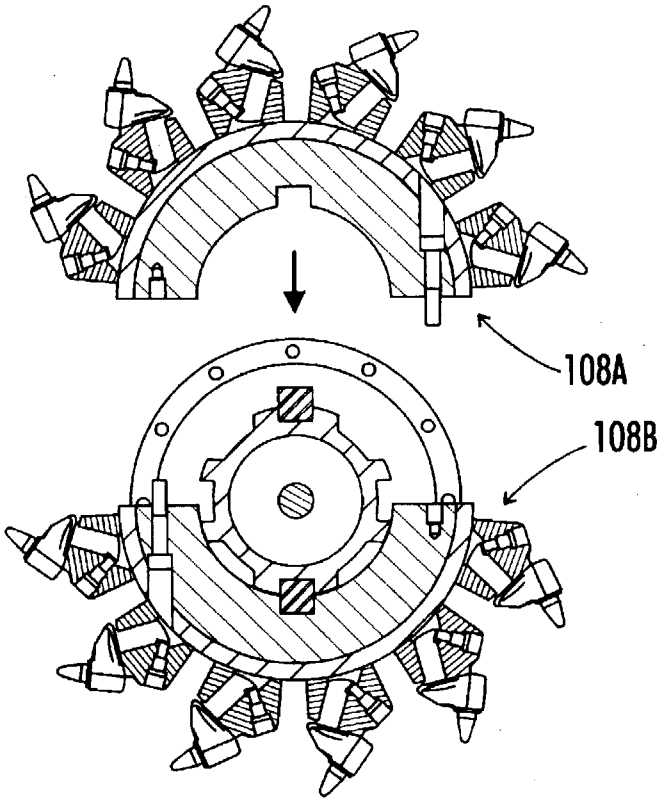
FIG. 11 is a cross section of the machine taken along the line C—C of FIG. 10.
Figure 13:
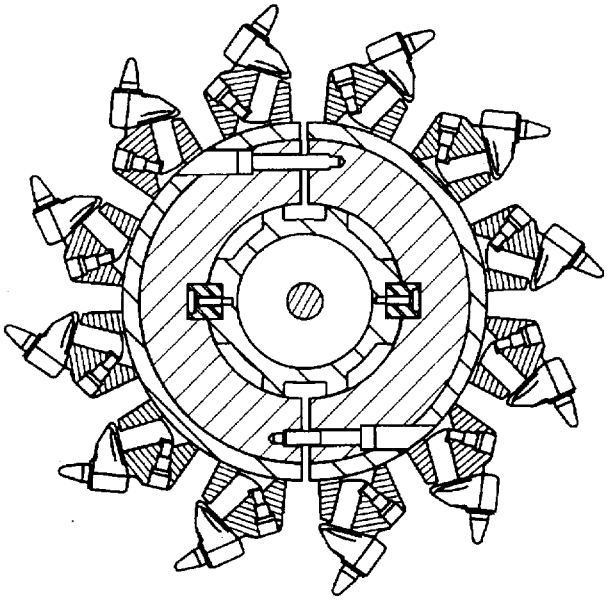
FIG. 13 is a cross section of the machine taken along the line D—D of FIG. 12.

FIGS. 11, 13 and 14 of the parent application describe the drive train for the milling drum. Four milling drums 22 are provided, the first a 1' foot section, the second a 2' section, the third a second 3' section and the fourth a 4' section. While the expense of having four drums is a factor, the even wear across the face of the drum, regardless of the width of the drum, makes the quality of the job offset the cost for most contractors.

The improved drums of the present invention are mounted on the casing of the planetary gear of the drive train of the machine as is illustrated in FIGS. 6–13. The planetary gear 126 is mounted via bearing assembly 132 to enable the planetary gear to rotate relative to the side board 46' in which the housing of the bearing assembly 132 is mounted. The face plate 134 of the planetary gear 126 rotates with the rotation of the planetary gear 126. Holes 138 are bored (and tapped with threads) about the perimeter of the face plate 134. In the illustrated preferred embodiment, the milling drum 104 is one foot in length and is divided into sections. In the embodiment illustrated there are two sections, 104A and 104B, with the milling drum 104 being split at line 23, as can be seen from FIG. 7.

A flange 134' extends about the right end of the drum (as viewed in FIG. 6) and projects radially inwardly toward the center or axis of the drum. The flange 134' of the drum has holes 138' spaced about its perimeter and the flanges 134, 134' are shaped to mate, with their holes in registry. Thus, the two segments 104A, 104B of the drum 104 can be bolted onto the outer flange of the planetary gear by bolts 136 and can be removed from the gear when the bolts are loosened and removed.

The sleeve 122 has diametrically opposed key ways 146 extending axially along the outer perimeter of the sleeve 122 from a point adjacent the side board 46 to the point where the planetary gear 126 meets the sleeve 122. When the milling drum 104 is mounted on the machine, the key ways 146 are filled with keys 148 to keep debris and waste material from clogging the key ways. The keys 148 are held in place by screws 150 passing through holes in the keys and being screwed into the sleeve 122 by threaded engagement with counterbored and tapped holes within the sleeve 122.

Figure 9:
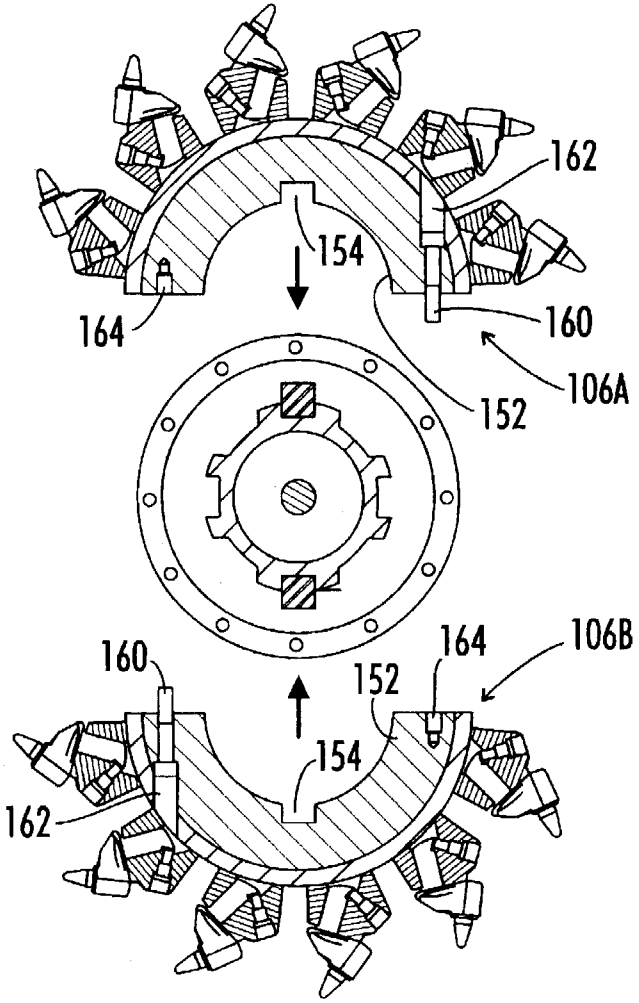
FIG. 9 is a cross section of the machine taken along the line B—B of FIG. 8.
Figure 8:
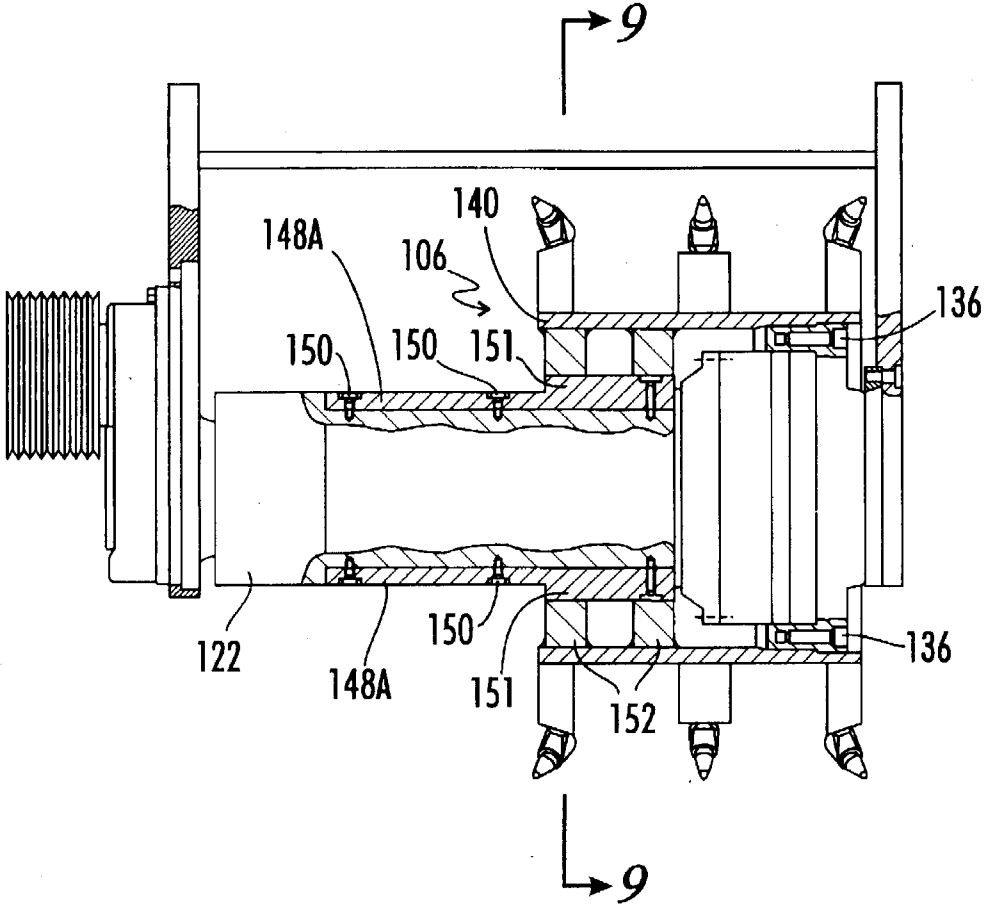
FIG. 8 is a plane view from the rear of the machine showing the drum configured for a 2' cut with portions of the drum shown in cross section.

When a cut wider than 1' is needed, the bolts 136 are unscrewed so that the sections 104A, 104B of the drum 104 can be removed from its mounting on the planetary gear, and the screws 150 are unscrewed so that the keys 148 can be removed from the key ways 146. Assuming a 2' cut is now needed, the milling drum 106 consisting of sections 106A and 106B (as illustrated in FIGS. 8 and 9) is mounted on the machine. The right side of the drum 106 (as viewed in FIG. 8) is configured substantially identical to the drum 104 and the mounting of the drum on the right side of the machine is via the screws 136 in the same fashion as drum 104 is mounted to the planetary gear. However, in order to transmit the driving power through the left side of the drum (as illustrated in FIG. 8), the left portion of the drum must be driven through the transfer of power from the sleeve 122.

In order to connect the left side of the drum 106 to the sleeve, keys 148A are inserted in the key ways 146 and attached to the sleeve 122 by screws 150. The keys 148A have a stepped-up shoulder section 151, and the inside of the drum portion 140 has one or more annular driving collars 152 protruding radially inwardly from the drum portion 140. The driving collars have axially extending elongated key ways 154 which are sized and shaped to mate with the shoulders 151 formed on the key 148A. Thus, the driving rotational force of the sleeve 122 is transmitted to the left side of the milling drum 106 by the connection of the driving collars 152 through the engagement of the shoulder 151 of the key 148A with the key way 154 in each of the segments 106A, 106B of the milling drum 106. The keys 148A are removably connected to the sleeve in order that worn keys can be easily replaced. In one embodiment, the shoulder 151 can run the full length of the key, but such keys are subject to rapid deterioration by virtue of their exposure to debris being propelled about the drum. A permanent shoulder would be chewed up or damaged by the debris and waste material, and eventually would not fit into the key way to transmit the driving force to the left side of the drum and would have to be replaced. In the preferred embodiment, rather than having a shoulder permanently formed into the full length of the keys (or in the sleeves themselves), various pairs of keys in each set of keys have shoulders of lengths designed to mate with the size of the particular drum with which they are intended to be used.

In addition to their connection to the sleeve, the two sections 106, 106A of the drum 106 are connected to each other via screws 160 passing through holes 162 in each of the sections with the screws threadedly engaging a tapped hole 164 in the opposing sections.

Once again, by the structure provided, the milling machine can be readily and easily changed from a 1' to a 2' cut by a single person in a limited amount of time by unbolting a few bolts and removing a segmented milling drum and replacing the segmented milling drum with a segmented milling drum of a different size. This structure allows even wear on the tooth holders of the various replacement drums so that an even cut will be created with each use of the machine.

Figure 10:
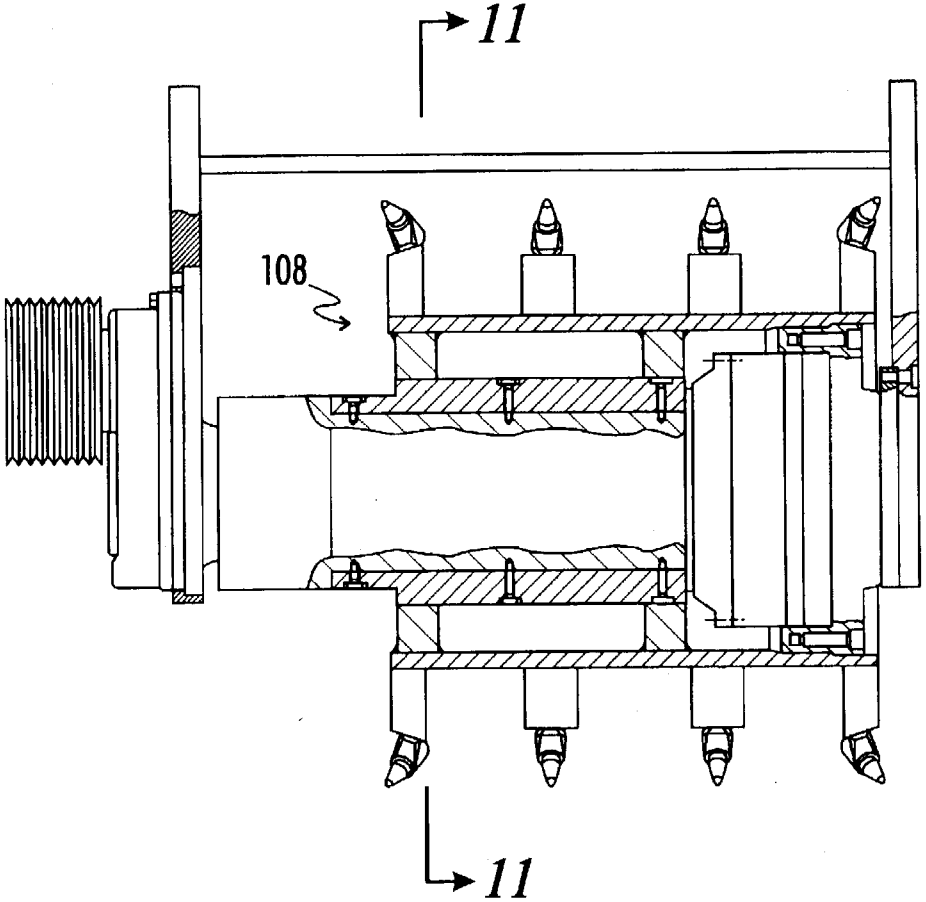
FIG. 10 is a plane view from the rear of the machine showing the drum configured for a three-foot cut with portions of the drum shown in cross section.
Figure 12:
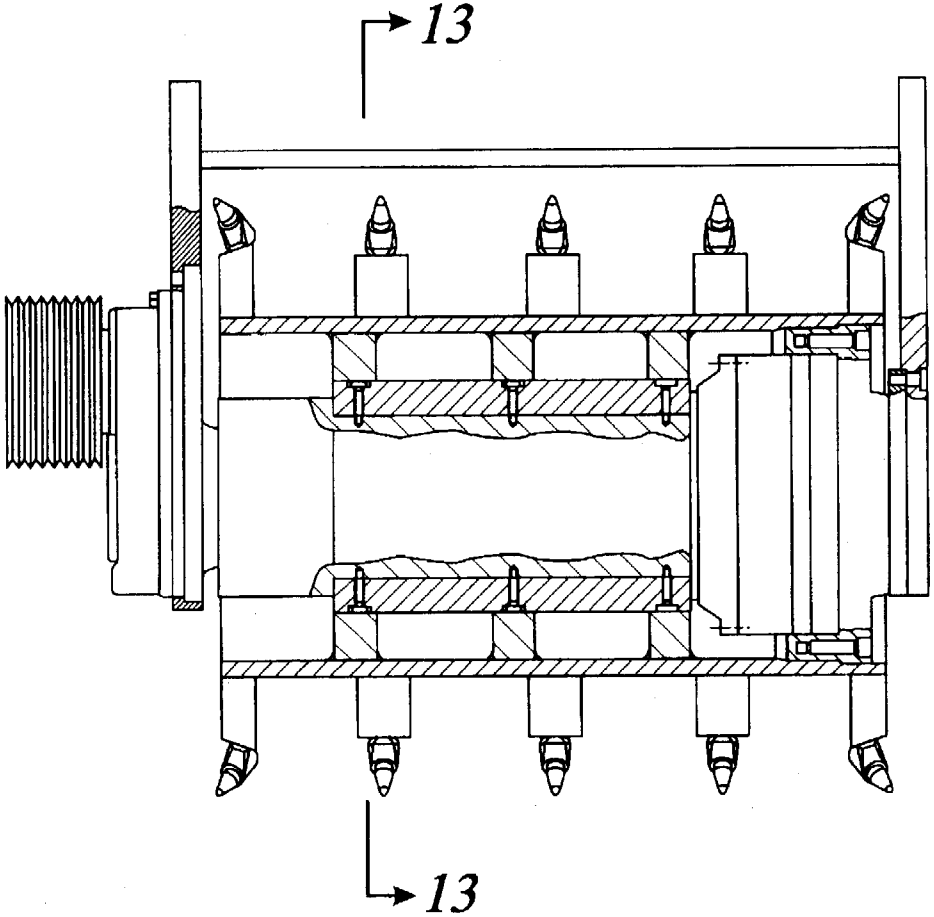
FIG. 12 is a plane view from the rear of the machine showing the drum configured for a four-foot cut with portions of the drum shown in cross section.

FIGS. 10 and 11 illustrate the configuration of the drum 108 having sections 108A and 108B. The drum 108 would three-feet long and thereby enable the milling drum to make a three-foot cut. Likewise, FIGS. 12 and 13 illustrate a four-foot drum which is of similar construction to the other drums but which will make a four-foot cut when installed on the machine.

Although there have been described particular embodiments of the present invention of a new and useful Milling Machine With Improved Multi-Width Cutter, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. An improvement to a cold milling machine having a front, an back and opposing sides, such machines having means for advancing the machine along a given path and a milling drum mounted on the machine for cutting a width of material in the path of the machine, said machine including a drive train having a power input end on one side of the machine and a power output end on the other side of the machine, said power input end of said drive train connected to a power source, said power output end of said drive train connected to a gear mounted within a gear housing, said gear housing having opposing ends, one end of said gear housing being generally flush with the other side of said machine, said gear housing being mounted for rotation relative to said machine, a sleeve extending from the other end of said gear housing toward said one side of said machine, means for rotatably driving said sleeve, said the improvement including:

a. a set of milling drums, each drum in said set of milling drums having opposing ends and being of a different length;

b. each drum in said set of milling drums being divided into segments;

c. means for releasably connecting one end of any selected one drum of said set of milling drums to said one end of said gear housing; and d. a connector element on the other end of at least one of said drums in said set of milling drums whereby said at least one of said drums can be releasably connected at its other end to said sleeve.

2. The invention of claim 1 further including means for releasably connecting the segments of each drum to each other.

3. The invention of claim 2 wherein said means for releasably connecting said segments includes a bolt passing through a bore in one segment and threaded into a tapped hole in the other segment of a drum.

4. An improvement to a cold milling machine having a front, an back and opposing sides, such machines having means for advancing the machine along a given path and a milling drum mounted on the machine for cutting a width of material in the path of the machine, said machine including a drive train having a power input end on one side of the machine and a power output end on the other side of the machine, said power input end of said drive train connected to a power source, said power output end of said drive train connected to a gear mounted within a gear housing, said gear housing having opposing ends, one end of said gear housing being generally flush with the other side of said machine, said gear housing being mounted for rotation relative to said machine, a sleeve extending from the other end of said gear housing toward said one side of said machine, means for rotatably driving said sleeve, said the improvement including:

a. a set of milling drums, each drum in said set of milling drums having opposing ends and being of a different length;

b. each drum in said set of milling drums being divided into segments;

c. at least one key way in said sleeve;

d. a set of keys, each key in said set of keys being of a size and shape to fill said key way;

e. means for releasably connecting one end of any selected one drum of said set of milling drums to said one end of said gear housing;

f. means for removably connecting any selected one key of said set of keys to said sleeve; and g. an annular driving collar protruding radially inwardly from the other end of at least one drum of said set of milling drums whereby drums of different lengths can be mounted on said machine in combination with one of said keys and be connected at their other end to said sleeve to receive driving force at said other end from said sleeve.

5. The invention of claim 4 wherein the means for releasably connecting any selected one key of said set of keys to said sleeve includes a threaded fastener passing through a hole in the key and threadedly engaged with a tapped hole in said sleeve.

6. The invention of claim 4 wherein the connector elements are in the form of a boss protruding from the key, said boss sized and shaped to mate with an opening in the other end of at least one of said drums to transmit rotating force from said sleeve to the said other end of said at least of one of said drums.

7. An improvement to a cold milling machine having a front, an back and opposing sides, such machines having means for advancing the machine along a given path and a milling drum mounted on the machine for cutting a width of material in the path of the machine, said machine including a drive train having a power input end on one side of the machine and a power output end on the other side of the machine, said power input end of said drive train connected to a power source, said power output end of said drive train connected to a gear mounted within a gear housing, said gear housing having opposing ends, one end of said gear housing being generally flush with the other side of said machine, said gear housing being mounted for rotation relative to said machine, a sleeve extending from the other end of said gear housing toward said one side of said machine, means for rotatably driving said sleeve, said the improvement including:

a. a set of milling drums, each drum in said set of milling drums having opposing ends and being of a different length;

b. each drum in said set of milling drums being divided into segments;

c. at least one key way in said sleeve;

d. a set of keys, each key in said set of keys being of a size and shape to fill said key way;

e. means for releasably connecting one end of any selected one drum of said set of milling drums to said one end of said gear housing;

f. means for removably connecting any selected one key of said set of keys to said sleeve; and g. all but one key of said set of keys having a connector element, each said connector element being of a length different from the length of the connector element of every other key and a mating connector element on the other end of at least one drum of said set of milling drums whereby drums of different lengths can be mounted on said machine in combination with one of said keys in said set of keys and be connected at their other end to said sleeve.

* * * * *